United States Patent [19]

Swan

[11] Patent Number: 4,714,294

[45] Date of Patent: Dec. 22, 1987

[54] DRUM AND CUTTER ASSEMBLY FOR A PLANING MACHINE

[75] Inventor: Leo Swan, Jefferson, Md.

[73] Assignee: Equipment Development Company, Inc., Frederick, Md.

[21] Appl. No.: 876,489

[22] Filed: Jun. 20, 1986

[51] Int. Cl.[4] ..... E01C 23/09

[52] U.S. Cl. ..... 299/39; 29/423; 29/426.4; 51/176; 125/5

[58] Field of Search ..... 299/39, 40, 91; 125/3, 125/5; 51/176; 29/423, 426.4; 221/312 A, 206; 76/101 A; 409/346, 231, 232; 175/373; 404/90, 91

[56] References Cited

U.S. PATENT DOCUMENTS

| | | | |
|---|---|---|---|
| 1,758,647 | 5/1930 | Burrell et al. | 125/5 |
| 1,964,746 | 7/1934 | Sloan | 299/39 |
| 2,784,482 | 3/1957 | Emmons | 125/5 |
| 3,156,231 | 11/1964 | Harding | 125/5 |
| 4,275,928 | 6/1981 | Jackson | 299/39 |

*Primary Examiner*—Stephen J. Novosad
*Assistant Examiner*—David J. Bagnell
*Attorney, Agent, or Firm*—Birch, Stewart, Kolasch & Birch

[57] ABSTRACT

A cutter subassembly for a concrete planing machine which is comprised of an elongated acrylic plastic tube on which is manually assembled a set of circular multi-toothed cutting elements and annular spacers arranged in a predetermined order to provide a desired cutting configuration along a linear axis. The cutting elements and spacers are assembled in a jig which additionally permits the attachment of a retaining clip at each end for holding the cutting elements and spacers in a fixed position on the tube. A plurality of completed cutter subassemblies are mounted on the cutter shafts of a drum assembly of the planing machine. Upon rotation of the drum assembly, the acrylic tube of each cutter subassembly disintegrates, providing the needed relative radial movement or play between the cutting elements and the cutter shaft during a planing operation.

19 Claims, 12 Drawing Figures

OPEN POSITION
( TO REMOVE SHAFTS)

LOCKED POSITION

DRUM AND CUTTER ASSEMBLY FOR A PLANING MACHINE

BACKGROUND OF THE INVENTION

The present invention relates to machinery for planing flat surfaces comprised of, for example, concrete or asphalt. More particularly, the present invention relates to an improved drum and cutter assembly for such planing apparatus.

Planes utilized in connection with concrete or asphalt surfaces are generally known and are typically used during a resurfacing operation, removing paint and/or removing excess concrete/asphalt to provide a desired finished surface state. Such apparatus is generally comprised of an engine driven drum and cutter assembly located at the front of a wheeled carriage which is guided by an operator. The drum and cutter assembly is oriented transversely across the carriage and horizontal to the surface to be planed. The cutter subassembly which is mounted on the drum is comprised of sets of circular multi-toothed cutting elements and annular spacers which are mounted on a plurality of cutter shafts which rotate about the central axis through the assembly. The cutting elements and annular spacers are manually assembled piece by piece on each shaft in a predetermined configuration depending upon the task at hand or when repair is required. An inherent limitation exists inasmuch as it is a time consuming operation when the cutting elements and spacers must be individually placed on the respective shafts each time a change is required in the planing configuration. This is unnecessarily tedious and inefficient, particularly when working at a job site. A typical example of the known type of planing machine is shown and disclosed in U.S. Pat. No. 3,156,231, issued Nov. 10, 1964, which is, moreover, assigned to the assignee of this invention.

SUMMARY

Accordingly, it is the primary object of the present invention to provide an improvement in apparatus for planing rough surfaces.

It is another object of the present invention to provide a new improved plane for resurfacing concrete and/or asphalt surfaces.

It is a further object of the present invention to provide an improved drum and cutter assembly for planing apparatus.

It is still another object of the invention to provide a means for facilitating the preassembly of a cutter subassembly mounted on a cutter drum of a planing machine.

The objects of the present invention are fulfilled by providing an elongated acrylic plastic tube which holds a set of multitoothed circular cutting elements and annular spacers which are arranged in a predetermined order on the tube to provide a desired planing cutting pattern spanning a predetermined dimension along a linear axis parallel to the surface to be planed. The cutting elements and spacers are assembled by hand in a jig which permits the elongated plastic tube to be oriented in a vertical position for receiving the cutting elements and annular spacers. The jig additionally permits the attachment of a retaining clip at each end of the tube for holding the assembled pieces together. Once assembled, the completed cutter subassembly is mounted on a cutter shaft of which there are a plurality of cutters and spacers arranged parallel to and offset from the central axis of the cutter drum which is rotatably driven by a motor. Upon rotation of the drum assembly, the acrylic tube of the cutter subassembly disintegrates, providing the required relative radial movement or play between the cutting elements and the cutter shaft.

BRIEF DESCRIPTION OF THE DRAWINGS

The objects of the present invention and the attendant advantages thereof will become more readily apparent by reference to the following drawings wherein like numerals refer to like parts, and wherein:

FIG. 5 is a perspective view of a six cutter shaft drum subassembly for the drum and cutter assembly shown in FIGS. 2 and 3;

DETAILED DESCRIPTION OF THE PREFERRED EMBODIMENT

Figure 1:
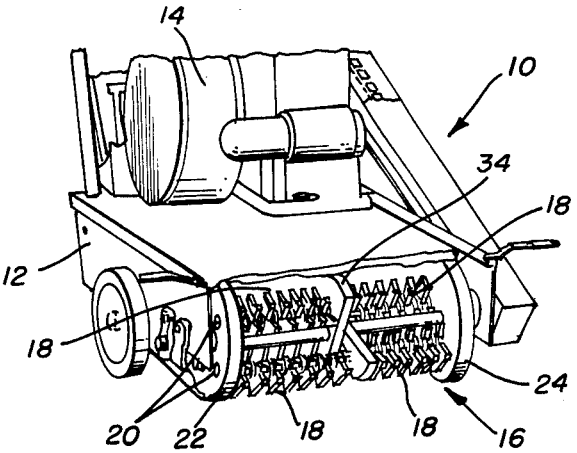
FIG. 1 is a fragmentary perspective view generally illustrative of a planing machine.

Referring now to the drawings and more particularly to FIG. 1, reference numeral 10 denotes what is commonly referred to as a plane utilized, for example, in resurfacing concrete/asphalt surfaces. The plane 10 includes, among other things, a carriage 12 which supports an engine 14 which is adapted to power and rotate a drum and cutter assembly 16 which spans the width of the carriage 12. The assembly 16 supports a plurality of cutter subassemblies 18 which are mounted on respective cutter shafts 20 between a pair of end plates 22 and 24. This is further shown in FIGS. 2 and 3 where there is disclosed two typical prior art drum and cutter assemblies.

Figure 2:
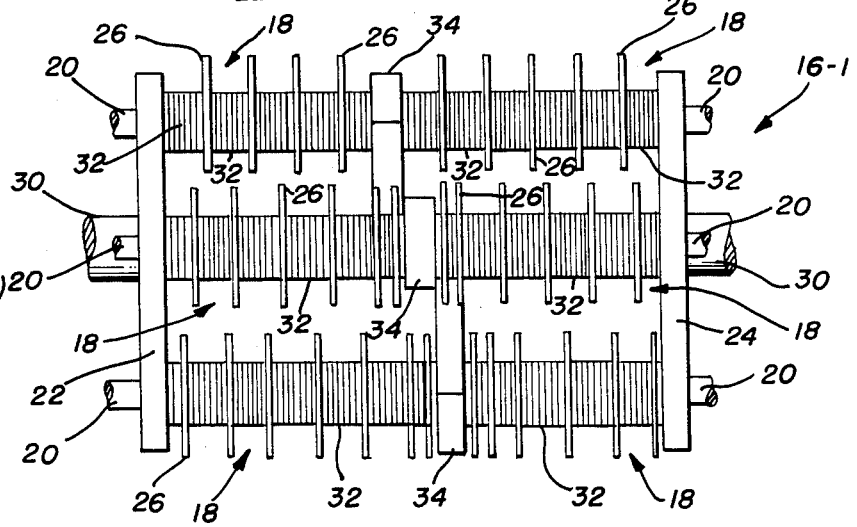
FIG. 2 (PRIOR ART)
FIGS. 2 and 3 are longitudinal central cross sections of known prior art drum and cutter assemblies used in connection with the apparatus shown in FIG. 1.

Referring now to FIG. 2, a first example of a typical known prior art cutter and drum assembly comprises the assembly 16-1 and wherein a plurality of circular toothed cutting elements 26 are arranged in spaced relationship on respective cutter shafts 20 which are arranged around and offset from a central drive shaft 30 which is coupled to and driven by the motor 14 in FIG. 1. The cutter elements 26 are separated from each other by a plurality of like sized annular flat spacers 32. In order to provide support for the cutter shafts 20, a plurality of brace members 34 mounted on the drive shaft 30 extend radially outwardly therefrom to a respective cutter shaft 20 midway between the end plates 22 and 24. Further as shown in FIG. 2, the array of cutter elements 26 are mutually offset with respect to the cutting elements on the adjacent cutter shaft 20 in order to provide a resultant cylindrical cutting surface which is co-extensive across the span of the two end plates 22 and 24.

Figure 4:
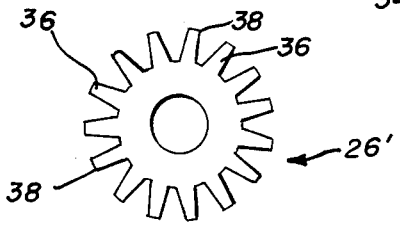
FIGS. 4 and 5 are top planar views generally illustrative of two types of cutter elements utilized in connection with the drum and cutter asemblies shown in FIGS. 2 and 3.
Figure 5:
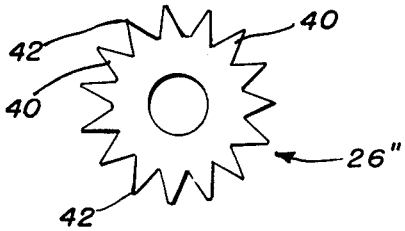

The configuration shown in FIG. 2, for example, would require 68 cutting elements and 426 spacers which would provide a medium finish planed surface. This might be described as a general purpose arrangement for the removal of excess concrete/asphalt or provides an ideal surface for bonding overlayment or epoxy coatings in a resurfacing operation. The cutting elements 26 comprise circular generally flat multi-toothed elements such as shown in FIGS. 4 and 5. FIG. 4, for example, discloses a cutting element 26' having a plurality of radial cutting teeth 36 which have blunt outer end surfaces 38 while the cutting element 26" shown in FIG. 5 includes a plurality of radial cutting teeth 40 which terminate in a point 42 as shown.

Figure 3:
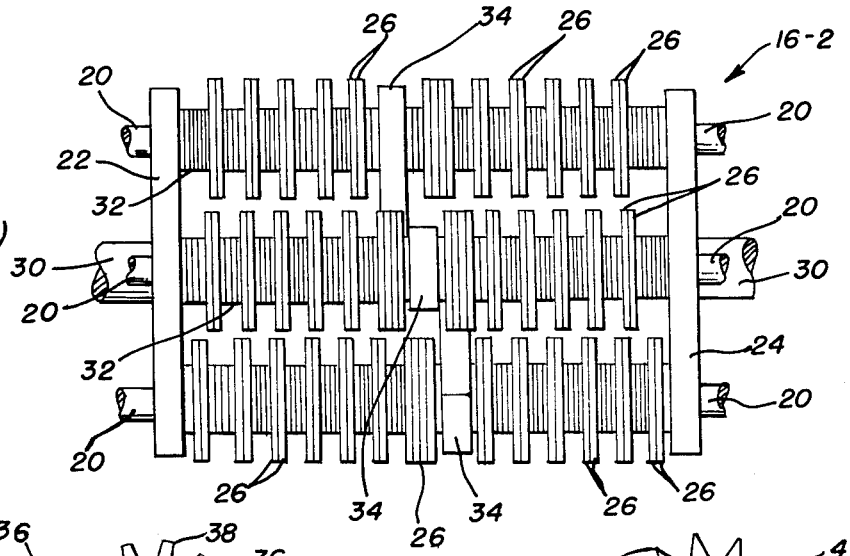
FIG. 3 (PRIOR ART)

A variation of the drum and cutter assembly shown in FIG. 2 is disclosed in FIG. 3. There a drum and cutter assembly 16-2 is shown comprising pairs of cutting elements 26 which are contiguously placed side by side on respective cutter shafts 20 while being spaced apart by a plurality of spacers 32 while being spaced apart by a plurality of spacers 32 between pairs of cutting elements. In order to compensate for the space taken up by the center braces 34, the innermost cutter elements comprise selectively placed sets of four cutter elements 26 arranged on one or both sides of a respective center brace 34. Such a configuration requires a total of 150 cutter elements and 292 spacers. In its operation it provides a fine broom like finish to the planed surface and is particularly useful for fast cutting of shallow depths as well as for traffic line and epoxy removal.

In accordance with prior art practice, all of the cutting elements 26 and spacers 32 are assembled piece by piece on the cutter shafts 20 of the drum and cutter assembly 16 as the job dictates.

Figure 6:
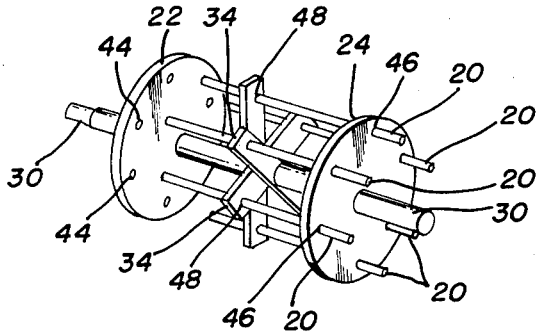

Referring now to FIG. 6, this piecemeal assembly operation is carried out for the embodiment shown in FIGS. 2 and 3 by sliding each of the six cutter shafts 20 through equally spaced respective bore holes 46 and 48 in the end plates 22 and 24 respectively.

Figure 7:
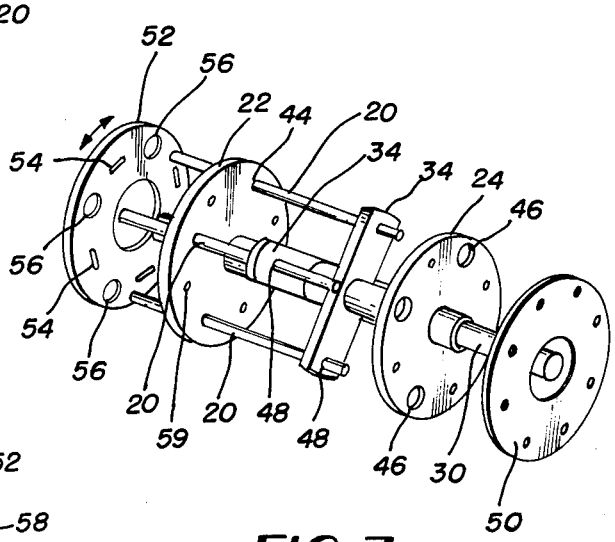
FIG. 7 is an exploded perspective view of a simplier four cutter shaft drum subassembly.
Figure 8:
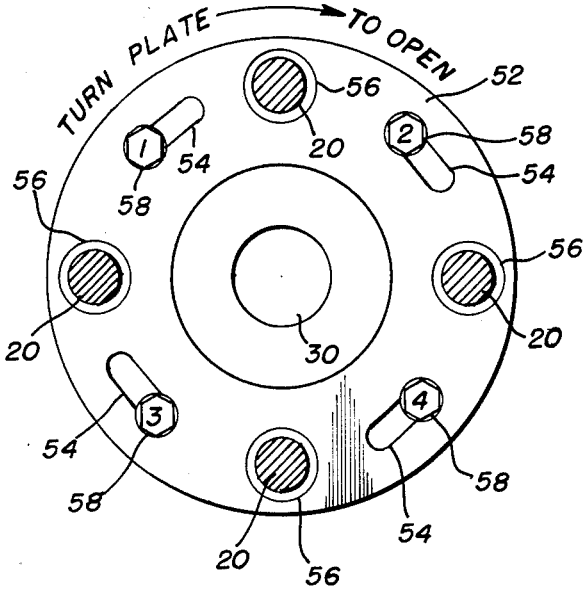
FIGS. 8 and 9 are two illustrative diagrams of the manner in which a locking plate of the drum assembly shown in FIG. 7 operates to lock the cutter shafts in place on respective drum assemblies.
Figure 9:
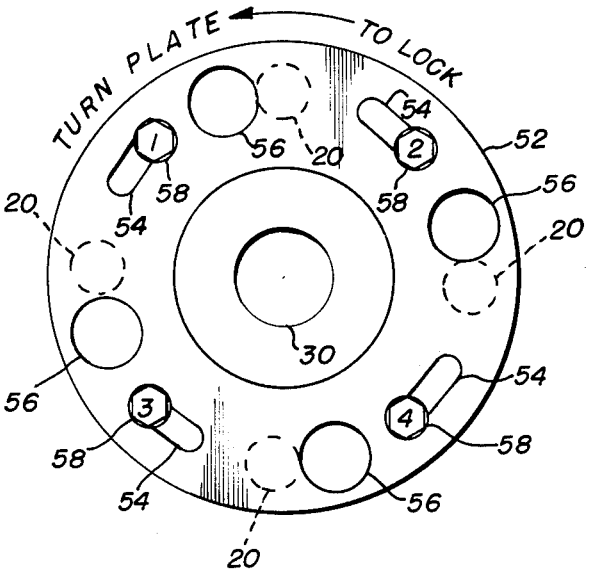

A simpler version of the drum assembly, without cutting elements and spacer elements assembled thereon, is shown in FIG. 7 and comprises an arrangement having only four cutter shafts 20 slidably linked between the end plates 22 and 24 having just two center braces 34 located midway between the end places 22 and 24. What is additionally disclosed in FIG. 7 is the means by which the cutter shafts 20 are locked in position between the end plates once loaded with an array of cutter elements 26 and spacers 32, not shown. This typically involves the use of an outer retaining plate member 50 secured, for example, by screws, not shown, to the outer surface of the right end plate 24 and an outer rotatable locking plate 52 located externally of the left hand end plate 22. The locking plate 52, moreover, includes a plurality of equally spaced slots 54 between a number of equally spaced bores 56 through which a respective cutter shaft 20 can pass therethrough when aligned with the bores 44 and 46 in the end plates 22 and 24. The rotatable locking plate 52 furthermore is shown in FIGS. 8 and 9 in an open and locked position respectively. Each of these positions is determined by tightening and loosening a set of bolts 58 which pass through the slots 54 and engage threaded holes 59 (FIG. 7) in the end plate 22. As shown in FIG. 8, in the open position, the bores 56 are aligned with the location of the four cutter shafts 20, while in FIG. 9, the locking plate 52 is shown rotated counter-clockwise so that the inner surface of the plate member 52 abuts the ends of the cutter shafts 20 so that they cannot be removed.

The present invention is directed to an improvement in the assembling and changing the pattern of cutting elements, on demand, as the specific task at hand dictates. The invention removes the piecemeal assembly of the cutting elements 26 and annular spacers 32 in favor of a preassembled arrangement of these components prior to their being installed on a drum assembly as shown in FIGS. 6 and 7.

Figure 10:
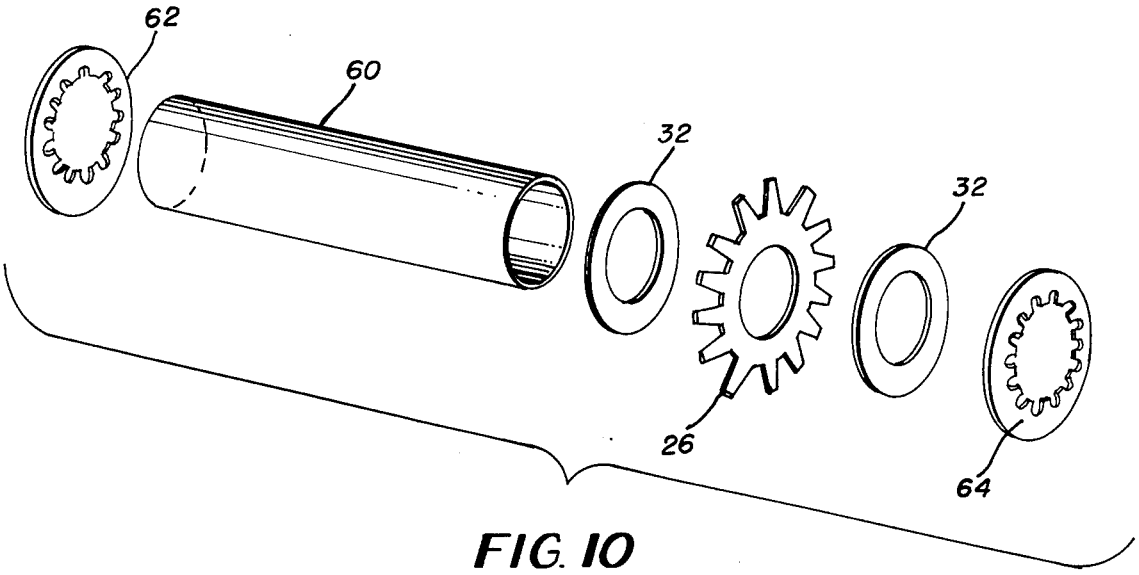
FIG. 10 is an exploded perspective view of the improved cutter subassembly comprising the preferred embodiment of the subject invention.
Figure 11:
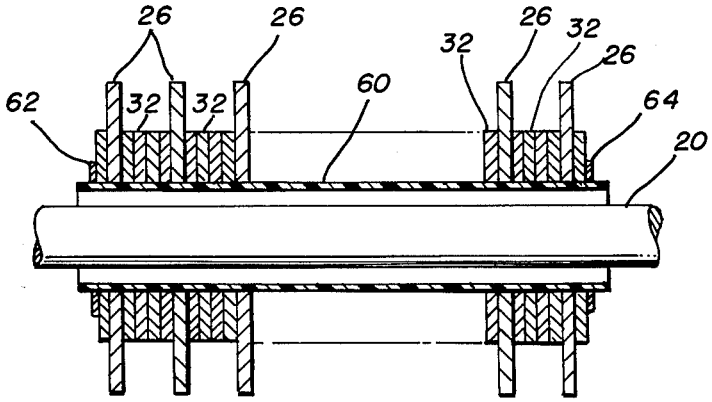
FIG. 11 is a central longitudinal cross sectional view of a preassembled cutter subassembly in accordance with the subject invention mounted on a cutter shaft.

Referring now to FIG. 10, reference numeral 60 denotes an elongated tube having a length dimension ranging between 4.0 and 6.0 inches and comprised of acrylic plastic upon which a plurality of cutting elements 26 and spacers 32 are placed in order to form a predetermined cutter configuration such as shown in FIGS. 2 and 3 while being held in place by a pair of circular metal clips 62 and 64 and having a serrated circular inner surface which fits over the outer diameter of the tube 60. The cutting elements and spacers include central circular bores of approximately 1.0 inches in diameter and accordingly the dimension of the outer diameter of the tube 60 is slightly less than 1.0 inch, being for example $0.960 \pm 0.015$ inches while having a wall thickness ranging between 0.05 and 0.06 inches. Typically the outer diameter of cutting elements is 3.0 inches or more while the outer diameter of the spacers is at least 1.5 inches. The components are assembled by hand into the desired cutting configuration, for example, as shown in FIG. 11 where they are then loaded onto a cutter shaft 20. What this accomplishes is a reduction in loading time on the planing machine. For example, the loading time required for a conventional drum and cutter assembly as shown in FIGS. 2 and 3 is thirty five to forty minutes; however, with a preassembled cutter subassembly on the acrylic plastic tube 60, loading of preassembled cutter subassemblies can be accomplished in about one minute.

Figure 12:
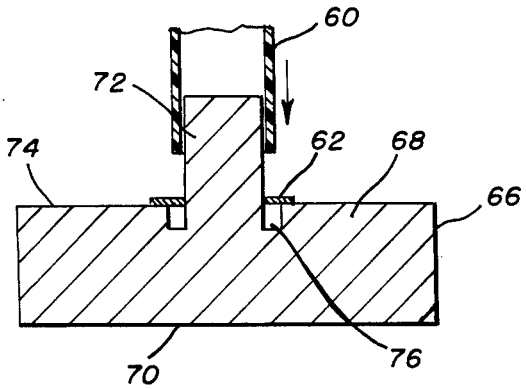
FIG. 12 is a longitudinal central cross sectional view of a jig used for assemblying the cutter subassembly shown in FIG. 9.

In order to facilitate the manual assembly of the cutter elements 26 and spacer elements 32 on the acrylic plastic tube 60, a mounting jig 66 shown in FIG. 12 is provided. The jig is comprised of a body member 68 having a substantially flat bottom surface 70 for placement on a table or bench, not shown. Body member 68 additionally includes an upwardly projecting solid cylindrical portion 72 which extends above the upper surface 74 and having a diameter slightly less than the inner wall diameter of the tube 60 so that the tube can be slid downwardly thereover and be held in a vertical position. A circular recess 76 is formed at the base of the cylindrical portion 72 so that the lower extremity of the tube can extend into the recess when a downward movement is provided, for example, by an operator. The recess 76 has for its objective the placement of a retaining clip 62 (FIG. 10) on the end of the tube both at the beginning and end of an assembling operation prior to its loading onto a cutter shaft 20 as shown in FIG. 11.

As further shown in FIG. 12, a retaining clip is placed over the base portion 72 where it rests on the upper surface 74 with the recess 76 being situated beneath it. As the tube 60 is pushed down over the clip 62, the serrated inner edge thereof engages the outer wall surface of the tube 60. Thus when assembly is begun, one of the clips 62, for example, is placed on the jig 66 which is followed by forcing the tube 60 downwardly over the jig portion 72 which engages the clip. While in place, a set of cutter elements 26 and spacer elements 32 are manually stacked on the tube 60 in the desired combination. When all of the cutter and spacer elements are in place, the tube 60 is taken off the jig and the other spacer, for example 64, is placed on the jig and the other end of the tube 60 is forced down over the cylindrical jig portion 72 for securing the clip to the other end of the subassembly. Once this operation is completed, it can be stored or immediately mounted on the cutter shaft 20 of the paving machine, e.g. the machine 10 shown in FIG. 1.

In operation, while the acrylic plastic tube disintegrates as soon as the paving machine 10 on which the preassembled cutter subassembly begins to rotate. The tube 60 is effect pulverizes and in doing so provides a needed radial separation or "play" between the cutter elements 26 and spacer 32 and the cutter shaft 20 on which they are mounted. This play is needed for proper machine operation when the cutting elements come to bear on the surface being planed.

Thus what has been shown and described in an improvement in planing machines which permits the assembly of preassembled cutter subassemblies on a drum in a fraction of the time heretofore required. This is coupled with the additional feature that the plastic tube upon which the cutter elements are mounted disintegrates just as soon as it is put into operation providing the needed clearance between the cutting elements and the cutting shaft on which it is mounted.

It should be further understood that many other variations of the invention described herein may be made as would occur to one of ordinary skill in the art without department from the general spirit and scope of the present invention.

What is claimed is:

1. In a planing machine having at least one rotatably driven drum and cutter assembly for planing a surface, comprising:

a cutter shaft and at least one preassembled cutter subassembly mounted on said cutter shaft and wherein said subassembly further comprises, (a) an elongated frangible tube having an inner wall diameter which permits the tube to be mounted on said cutter shaft;

(b) a plurality of circular multitoothed cutting elements located on said tube in a predetermined order;

(c) a plurality of annular spacers on said tube selectively located on either side of said cutting elements to provide a predetermined spacing pattern of cutting elements along its length; and (d) means at either end of said tube for securing said cutting elements and spacers in position on said tube following assembly, said tube disintegrating upon being rotated during operation on said planing machine to provide a required predetermined radial separation between the cutting elements and cutter shaft.

2. The planing machine according to claim 1 wherein said cutting elements are comprised of flat elements of substantially constant thickness.

3. The planing machine according to claim 1 wherein said spacers are comprised of flat spacer elements of substantially constant thickness.

4. The planing machine according to claim 1 wherein said frangible tube comprises a tube composed of acrylic plastic material.

5. The planing machine according to claim 1 wherein said cutting elements and annular spacers include central circular bores having a diameter equal to or greater than the outer wall diameter of said tube.

6. The planing machine according to claim 1 wherein said frangible tube comprises an acrylic plastic tube having a length ranging between 4.0 and 6.0 inches, an outer diameter of 1.0 inch or less, and a wall thickness ranging between 0.05 and 0.06 inches.

7. The planing machine according to claim 6 wherein said cutting elements include a central circular bore having a diameter of at least 1.0 inch.

8. The planing machine according to claim 7 and wherein said cutting elements have an outer diameter of at least 3.0 inches or more.

9. The planing machine according to claim 6 wherein said spacers include a central circular bore having a diameter of at least 1.0 inch.

10. The planing machine according to claim 9 and wherein said spacers have an outer diameter of at least 1.5 inches.

11. A cutter assembly for mounting on a rotatable drum of a planing machine, comprising:

(a) a tubular member of predetermined length and thickness and being fabricated from material which pulverizes upon being subjected to torquing and compressional forces while in place on said planing machine during a planing operation.

(b) a plurality of circular cutting elements arranged in predetermined cutting pattern along said tubular member;

(c) a plurality of spacer members selectively arranged on either side of said cutting elements; and (d) retaining means on each end of said tubular member for holding said cutting elements and spacer members in place thereon.

12. The cutter assembly according to claim 11 wherein said tubular member is fabricated from an acrylic plastic material.

13. The cutter assembly according to claim 11 wherein said cutting elements are comprised of toothed elements of predetermined constant thickness.

14. The cutter assembly according to claim 11 wherein said retaining means comprises a pair of retaining clips.

15. The cutter assembly according to claim 11 and additionally including means (d) for mounting said cutting elements, said spacer elements and said retaining means on said tubular member, said means comprising an assembly jig including, a base member having an upwardly projecting cylindrical body portion for viewing and holding said tubular member for the placement of said cutting elements and said spacer members thereon.

16. The cutter assembly according to claim 15 wherein said base member further includes an annular recess adjacent said cylindrical body portion for facilitating the affixation of said retaining means on said tubular member during an assembly operation prior to said cutter assembly being mounted on said rotatable drum.

17. The cutter assembly according to claim 15 wherein said retaining means comprise resilient clip type elements which engage the outer surface of said tubular member.

18. A method of preassembling a set of cutting elements on an elongated fracturable tube for subsequent mounting on a cutter shaft of a planing machine, comprising the steps of:

attaching a retaining clip to one end of said tube;

selectively placing said set of cutting elements and a set of spacers on said tube in direct contact therewith and in a predetermined order to form a desired linear cutting pattern;

attaching a retaining clip to the other end of said tube; and thereafter mounting the entire unit on said cutter shaft.

19. The method according to claim 18 wherein said steps of attaching and placing are carried out in an upright position on an assembling jig.

* * * * *